United States Patent [19]

Knowles et al.

[11] 4,169,647

[45] Oct. 2, 1979

[54] INTEGRAL LOW PROFILE LATCH FOR A FLAT CABLE CONNECTOR

[75] Inventors: Robert G. Knowles, Litchfield; Robert A. Domke, Newtown, both of Conn.

[73] Assignee: Litton Systems, Inc., Oakville, Conn.

[21] Appl. No.: 911,214

[22] Filed: Jun. 1, 1978

[51] Int. Cl.[2] ..... H01R 13/38

[52] U.S. Cl. ..... 339/99 R

[58] Field of Search ..... 339/97 P, 98, 99 R, 339/91 R, 206–210

[56] References Cited

U.S. PATENT DOCUMENTS

| | | | |
|---|---|---|---|
| 3,409,858 | 11/1968 | Krehbiel | 339/91 R |
| 3,994,554 | 11/1976 | Navarro | 339/99 R |
| 4,006,957 | 2/1977 | Narozyny | 339/99 R |

*Primary Examiner*—Joseph H. McGlynn

*Attorney, Agent, or Firm*—Brian L. Ribando

[57] ABSTRACT

A flat cable connector includes a contact support with an integrally molded latch and a pressure member which mates therewith. The latch comprises a folded beam and a latching bar which cooperate with a two-position catch on the pressure member. The folded beam gives the latch a greater flexibility than would normally be possible and avoids excess strain which could cause beam failure.

5 Claims, 2 Drawing Figures

Fig_1
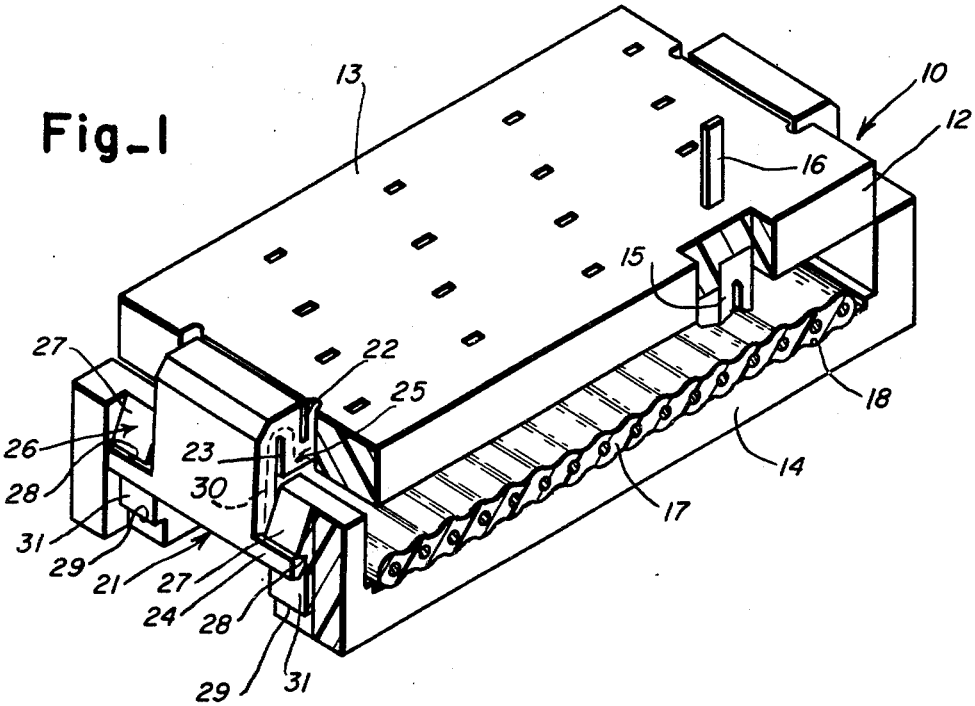
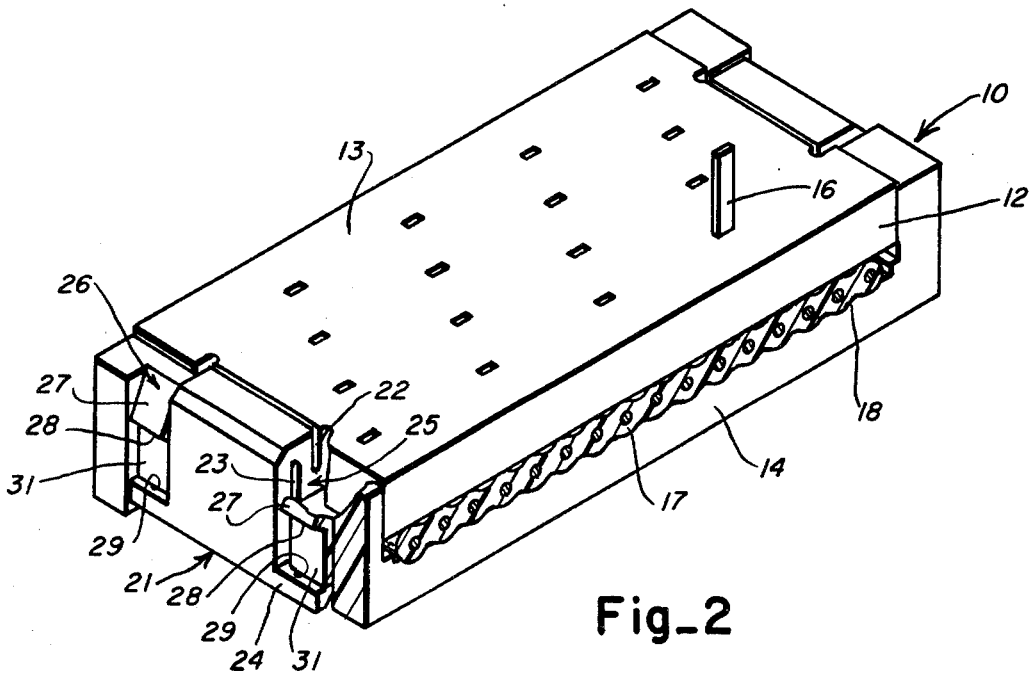
Fig_2

INTEGRAL LOW PROFILE LATCH FOR A FLAT CABLE CONNECTOR

BACKGROUND OF THE INVENTION

The invention relates to a connector for terminating flat multi-conductor cables in which an integral latch is formed with a folded beam to give the beam an enhanced flexibility.

Connectors for terminating flat multi-conductor cable are well known in the prior art. The U.S. Pat. No. 4,009,921, to Narozny, shows a connector including a base member, a cover member, and a cap member. The cap member is formed with an integral downward depending latch which passes through apertures in the cover member to mate with upper and lower slots formed on extensions of the base member. According to the Narozny design, the integral latch must deflect in order to clear the projection on the base member before engaging one of the two slots. Because the cap is formed of plastic, the bending of the latch often causes undesirable stress which leads to failure of the latch member, rendering the connector useless.

The U.S. Pat. No. 3,444,506, to Wedekind, shows a connector for terminating a flat multi-conductor cable comprising a base, and a cap. Bosses formed on the cap interlock with depressions formed on extensions of the base to lock the cap and base together with the flat cable trapped therebetween. Because the extensions on the base are integrally molded therewith, they are subject to breakage when deflection is experienced due to the cap being snapped into place.

SUMMARY AND OBJECTS OF THE INVENTION

A connector for terminating a flat multi-conductor cable includes a contact support on which is mounted a plurality of insulation displacement connectors. Latching members are integrally molded on the contact support and these members mate with a two-position cable which is molded on a pressure member. The latch is formed with a double slot to create a folded beam which has an effective length greater than a length measured from the contact support to the tip of the latch. The folded beam allows the latch greater flexibility which is required when the latch is deflected in the process of latching with the two-position catch.

It is therefore an object of the present invention to provide an integral low profile latch for a flat cable connector.

It is another object of the invention to provide a low profile latch integrally molded on one portion of a flat cable connector, which latch mates with the two-position catch on another portion of the connector.

It is a further object of the invention to provide a connector for terminating a flat multi-conductor cable in which an integrally molded latch is formed with a folded beam to allow greater flexure without undue stress which would otherwise cause latch failure as the latch is displaced to mate with a two-position catch.

These and other objects of the invention will become apparent from the following detailed description taken in conjunction with the accompanying drawing figures in which like reference numerals designate like or corresponding parts throughout the figures.

BRIEF DESCRIPTION OF THE DRAWING

FIG. 1 is a perspective view partly in section of the connector according to the present invention with the latch in the first position; and FIG. 2 is a perspective view partly in section of the connector according to the present invention with the latch in the second position.

DESCRIPTION OF THE PREFERRED EMBODIMENT

Referring now to the drawings, there is shown in FIG. 1 a flat cable connector generally designated by the reference numeral 10. The connector comprises a contact support 12 and a pressure member 14. The contact support may be provided with a plurality of insulation displacement contacts 15 (one of which is shown on the drawing). Each insulation displacement contact 15 may include a pin 16 which is used to make an electrical connection with an external circuit connector. The insulation displacement connectors are configured to pierce the insulation on a flat multi-conductor cable 17 and to make electrical contact with the conductive elements positioned therein. The cable 17 is supported and positioned within the connector 10 by means of a sculpted surface 18 which is formed on the pressure member 14.

A latch 21 is integrally formed on either end of the contact support 12. The latch 21 is partially separated from the main body of the contact support 12 by a first slot 22 which extends from the upper surface 13. A second slot 23 extends from the undersurface of the latch 21 and is generally parallel to the first slot 22. The latch terminates in a latching bar 24. The two slots 22 and 23 create a folded beam 25 for the latch 21 having a beam length which may be measured along the line indicated by the reference numeral 30 and which is much greater than the beam length created by a similarly configured latch without the provision of the two slots.

The pressure member 14 is provided on either end with a pair of detents 26. Each detent 26 comprises a bevel surface 27, a first catch 28, and a second catch 29. A space between the first catch 28 and the second catch 29 forms a supporting surface 31.

Turning now to FIG. 2, the connector is shown with the latch 21 in the second position. The latching bar 24 is trapped beneath the second catch 29 and a plurality of insulation displacement contacts (not shown) have been driven into flat multi-conductor cables 17 to establish electrical contact with the conductive elements located therein.

The operation and use of the device will be apparent to those skilled in the art. By aligning the contact support 12 with the pressure member 14, and more particularly, by resting the latching bar 24 on the bevel surface 27 of the detents 26, the connector can be latched in a first position by applying a downward force sufficient to cause the latching bar 24 to ride on the bevel 27 and to snap past the first catch 28 to rest on the supporting surface 31. Because of the provision of the two slots 22 and 23, the latch 21 is able to flex sufficiently to clear the first catch 28 without such a stress being applied to a beam 25 to cause a fracture thereof. The connector may be stored with the latch in the first position for an indefinite period of time. When it is desired to terminate a multi-conductor cable such as cable 17, sufficient space exists between the plurality of insulation displacement contacts 15 and the sculpted surface 18 that the cable may be placed therebetween. Pressure on the contact support 12 and the pressure member 14 will cause the two members to come together forcing the insulation displacement contacts 15 to pierce the insulation of the cable 17 making electrical contact with the conductors therein and causing the latching bars to slide on the support surface 31 until snapping past the second catch 29. Once the latching bar has been caught by the second catch 29, accidental separation of the contact support 12 from the pressure member 14 is impossible. While various non-conducting semi-rigid materials may be used in the fabrication of the contact support 12 and the pressure member 14, a plastic is preferred, and in particular, thermoplastic polyester may be employed.

Having thus described the invention, modifications and alterations thereof will occur to those skilled in the art, which modifications and alterations are intended to be within the scope of the present invention as defined in the appended claims.

We claim:

1. In a connector for terminating a flat multi-conductor cable and including a pressure member and a molded contact support in which is mounted a plurality of insulation displacement contacts, the combination comprising:

latch means for coupling said contact support to said pressure member, said latch means comprising a beam attached at one end to said contact support and terminated at the other end by a latching bar, means along said beam for increasing the effective length thereof whereby the beam length measured along the beam from the point of attachment to the latching bar is greater than the distance measured along a straight line from the point of attachment to the latching bar, and first catch means on said pressure member for retaining said latching bar in a first position.

2. The combination of claim 1 further comprising:

a first slot comprising the means along said beam for increasing the effective length thereof.

3. The combination of claim 2 further comprising:

a second slot in said beam, said second slot being spaced from and generally parallel to said first slot.

4. The combination of claim 3 further comprising:

a second catch means on said pressure member for retaining said latching bar in a second position, and a support surface between said first catch means and said second catch means.

5. In a connector for terminating a flat multi-conductor cable and including a pressure member and a molded contact support in which is mounted a plurality of insulation displacement contacts, the combination comprising:

latch means integrally molded with said contact support for coupling said contact support to said pressure member, said latch means comprising a beam attached at one end to said contact support and terminated at the other end by a latching bar, first and second slot means in said beam for increasing the effective length thereof whereby the beam length measured along the beam from the point of attachment to the latching bar is greater than the distance measured along a straight line from the point of attachment to the latching bar, said first slot means partially separating said beam from said contact support, and said second slot means extending from the undersurface of said beam, a first catch means on said pressure member for engaging said latching bar in a first latching position, a second catch means on said pressure member for engaging said latching bar in a second latching position, and a support surface between said first catch means and said second catch means.

* * * * *